United States Patent [19]

Martin et al.

[11] Patent Number: 4,910,891

[45] Date of Patent: Mar. 27, 1990

[54] DEVICE FOR ATTACHING EARTH-WORKING TOOLS TO EXCAVATING EQUIPMENT

[75] Inventors: James W. Martin; Thomas J. Martin, both of Golden, Colo.

[73] Assignee: Construction Technology, Inc., Denver, Colo.

[21] Appl. No.: 209,700

[22] Filed: Jun. 20, 1988

[51] Int. Cl.[4] ..... E02F 3/76

[52] U.S. Cl. ..... 37/117.5; 37/DIG. 12; 172/777; 299/40

[58] Field of Search ..... 37/117.5, DIG. 3, DIG. 12; 299/37, 40; 172/777, 778

[56] References Cited

U.S. PATENT DOCUMENTS

| | | | |
|---|---|---|---|
| 3,067,989 | 12/1962 | Moench | 299/40 |
| 3,083,954 | 4/1963 | Brolin | 299/40 |
| 3,136,078 | 6/1964 | Renault | 37/146 |
| 3,140,898 | 7/1964 | Rogers | 299/40 |
| 3,261,643 | 7/1966 | Moench | 299/40 |
| 3,355,214 | 11/1967 | McClure | 299/40 |
| 3,393,014 | 7/1968 | Ascher | 299/40 |
| 3,472,554 | 10/1969 | Hopkins | 299/40 |
| 3,515,435 | 6/1970 | Milligan | 299/40 |
| 3,743,358 | 7/1973 | Guest | 299/40 |
| 4,076,314 | 2/1978 | Dodich | 299/40 |
| 4,331,362 | 5/1982 | Talbert | 299/37 |
| 4,411,081 | 10/1983 | King | 37/DIG. 12 |
| 4,420,189 | 12/1983 | von Ruden | 299/40 |
| 4,597,205 | 7/1986 | Guest | 37/266 X |

*Primary Examiner*—Edgar S. Burr
*Assistant Examiner*—Moshe I. Cohen
*Attorney, Agent, or Firm*—Baker, Mills & Glast

[57] ABSTRACT

A device for attaching various earth-working tools to a bucket of excavating equipment, such as a front-end loader, backhoe, or excavator. A frame has two spaced parallel plates, each having a wedge-shaped notch on one side. A stabilizing bar, adjacent to the open end of the notches, connects the plates. The tool, such as an asphalt roller or cutter, is attached to the bottom of the frame between the plates. At the top of the frame, a clamping mechanism, having a pivoting arm, is mounted between the plates. To use the device, the excavator bucket is inserted into the wedge-shaped notch, with the device holding the bucket in place against the edges of the wedge-shaped notch, the stabilizing bar, and the pivoting arm of the clamping mechanism.

23 Claims, 5 Drawing Sheets

DEVICE FOR ATTACHING EARTH-WORKING TOOLS TO EXCAVATING EQUIPMENT

BACKGROUND OF THE INVENTION

This invention is for cutting or rolling asphalt or other surfaces, using a tool attached to excavating equipment such as a front-end loader, backhoe, or excavator. Each of these machines can have a bucket, to which the invention is attached.

The need for surface cutting and rolling tools arises during construction, when holes or ditches must be dug beneath existing surfaces. There are numerous methods for cutting through the surface so that it may be broken up and removed. One method is perforating the surface with power hammers. Another is the use of mobile cutting machines, such as asphalt saws, dedicated to this purpose, such as disclosed in U.S. Pat. No. 2,701,134. Similarly, for rolling smooth surfaces, machines dedicated to that purpose have been used. A disadvantage of these methods is that special equipment must be brought to the site that might not otherwise be required there.

A common method, which is the method used with this invention, is the use of cutting or rolling tools, which can be attached to mobile equipment already in use at the job site. Such equipment frequently includes graders, bulldozers, backhoes, front-end loaders, and other excavating equipment. These machines may have buckets, boards, or blades, to which the tool is attached, and thereby is driven. As the driving equipment moves forward and downward force is applied, the tool cuts or rolls the surface. Desired features of such attachments are that they be easily attached and detached, and while attached, maintain a stable and rigid connection to the driving equipment. The tool should not twist from side to side, or up and down with respect to the ground, as it is being advanced across or through the surface.

A common means for attachment uses the concept of a C-clamp, which fits over one wall of the bucket. A C-clamp type mechanism was used in a roller attachment manufactured in the 1960's. C-clamp mechanisms have also been used in several asphalt cutter devices. U.S. Pat. No. 3,743,358 to Guest uses this concept. Subsequent inventions, disclosed in U.S. Pat. No. 4,076,314 to Dodich, and U.S. Pat. No. 4,420,189 to von Ruden, modify the C-clamp.

Typically, buckets used with excavator equipment depend on a reinforced lip for strength. This lip consists of a strip of metal at the leading edge of the underside of the bucket. Relative to the lip, the bucket walls are easily deformed. If a bucket has been deformed, a problem with prior devices is that they do not successfully accommodate the deformation and provide stability while the device is in use. Because a large flat area of contact will tend to permit a distorted bucket to shift, many of the prior devices rely on discrete points of contact. Yet because of the relative thinness of the bucket walls, these points must be at the lip of the bucket, which does little to stabilize the tool during use.

Another feature of using tools attached to excavating equipment is that when these tools are driven to cut or roll surfaces, large forces are applied by the equipment through the tool to produce penetration or smoothing of the surface. This causes problems with prior attachment mechanisms, which have a limited area of contact between the roller or cutter tool and the bucket. The combination of the large forces and limited contact area increases the likelihood that the bucket will be punctured or bent. This is true of the C-clamp devices, in which contact with the bucket is limited to several discrete points, such as the ends of clamping screws and the forward edges of a C-clamp within a limited area at the lip of the bucket. Again, this configuration does little to promote stability. Additionally, the pressure of the bucket lip against the bearing end of the C-clamp will cause the metal there to fail. Deformation occurs, reducing the desired clamping action.

Alternatives to the use of a C-clamp have been attempted. In U.S. Pat. No. 4,331,362, an asphalt cutter is clamped to the bucket by means of a V-shaped mounting bracket. The bottom of the bracket receives the force from the bucket; thus this device does not overcome the problem of undue stress on the bucket lip. Furthermore, a bucket whose walls have become distorted and are no longer flat will tend to shift.

In light of these problems associated with using tools attached to excavating equipment buckets, the ideal attachment device should balance the needs for stability, the need to accommodate deformed buckets, and the need to protect the bucket walls. Accordingly, as explained below, this device described herein is designed to have zones of contact that are sufficiently spaced to provide stability, sufficiently large to discourage puncturing, and sufficiently discrete to accommodate deformities in the bucket. Furthermore, the device is designed to encourage transmission of forces to the frame instead of to the clamping mechanism, thereby reducing stress on the clamping mechanism.

SUMMARY OF THE INVENTION

One object of the invention is to provide a simple and rapid means for attaching earth-working tools to a bucket of excavating equipment.

Another object of the invention is to provide a simple and rapid means for attaching an asphalt cutting tool to a bucket of excavating equipment.

Another object of the invention is to provide a simple and rapid means for attaching a surface rolling tool to a bucket of excavating equipment.

Another object of the invention is to provide a means for attaching an earth-working tool to a bucket of excavating equipment that is stable and will inhibit undesired side-to-side or twisting motion.

Another object of the invention is to provide a means for attaching an earth-working tool to a bucket of excavating equipment that will minimize potential for puncturing or distorting the bucket to which it is attached.

Another object of the invention is to provide a means for attaching tools to a bucket of excavating equipment that will accommodate a deformed bucket.

Another object of the invention is to provide a device for attaching an earth-working tool to a bucket of excavating equipment that will transmit load forces directly to the frame of the device, thereby reducing forces on the device's clamping mechanism.

Another object of the invention is to provide a device for attaching an earth-working tool to a bucket of excavating equipment that can be used in any position on the cutting edge of the bucket, including over a tooth of smaller buckets having teeth and between the teeth of larger buckets having teeth.

Another object of the invention is to provide a device for attaching an earth-working tool to a bucket of excavating equipment that permits more than one device to be used on the same bucket.

DESCRIPTION OF THE PREFERRED EMBODIMENTS

Figure 1:
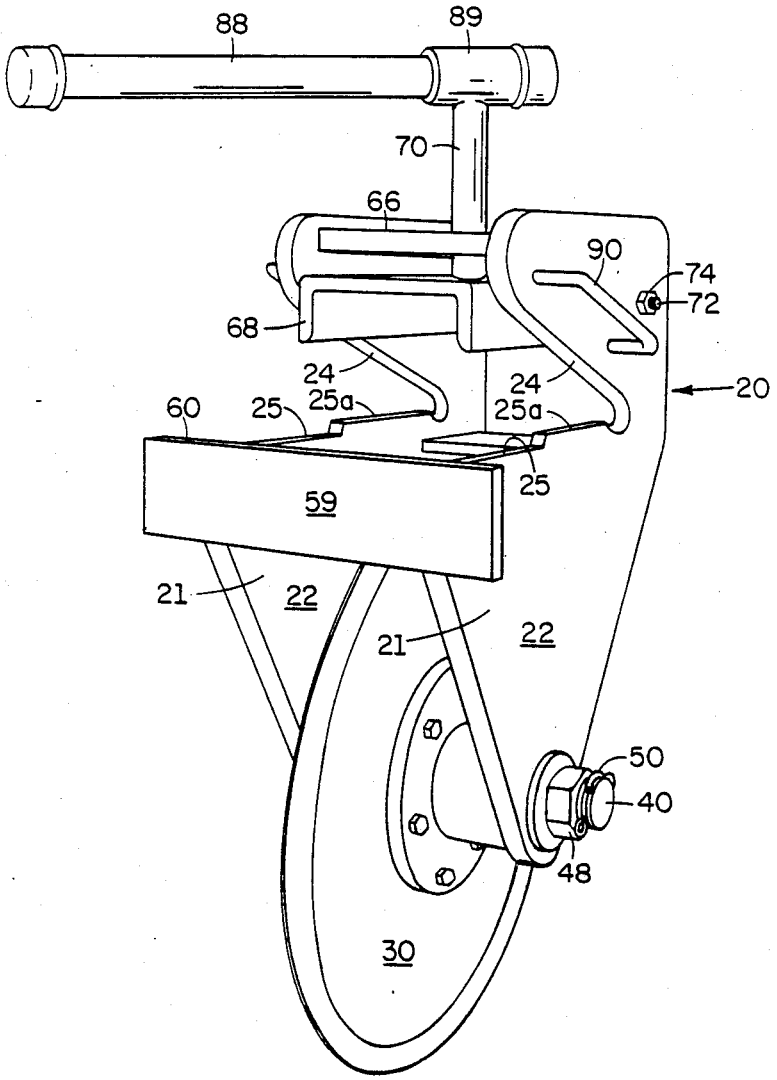
FIG. 1 is a rear perspective view of the invention as used to attach an asphalt cutting tool.

FIG. 1 is a rear perspective view of the preferred embodiment, as used with an asphalt cutting wheel. A frame 20, has two spaced, parallel plates 21, each plate 21 having a wedge-shaped notch at its rear end near the top of frame 20. This notch in frame 20 permits a bucket to be inserted into frame 20, and defines two pairs of bearing edges, upper bearing edges 24 and lower bearing edges 25. The bucket is in contact with at least one pair of these bearing edges 24 and 25 during use. In the preferred embodiment, the shape of each plate 21 is identical to the other. Plates 21 are of a strong durable material, such as steel and are sufficiently thick to provide strength to support cutter loads and provide lateral stability.

For the asphalt cutter embodiment, lower panels 22 of plates 21 are approximately in the shape of an isosceles triangle. At the apex of each lower panel 22, a cutting wheel 30 is mounted on a hub 46, between the two lower panels 22. Cutting wheel 30 is of a durable strong material with the outer edge shaped to facilitate cutting. In the preferred embodiment, cutting wheel 30 is made from a high strength, abrasive resistent alloy steel.

Figure 2:
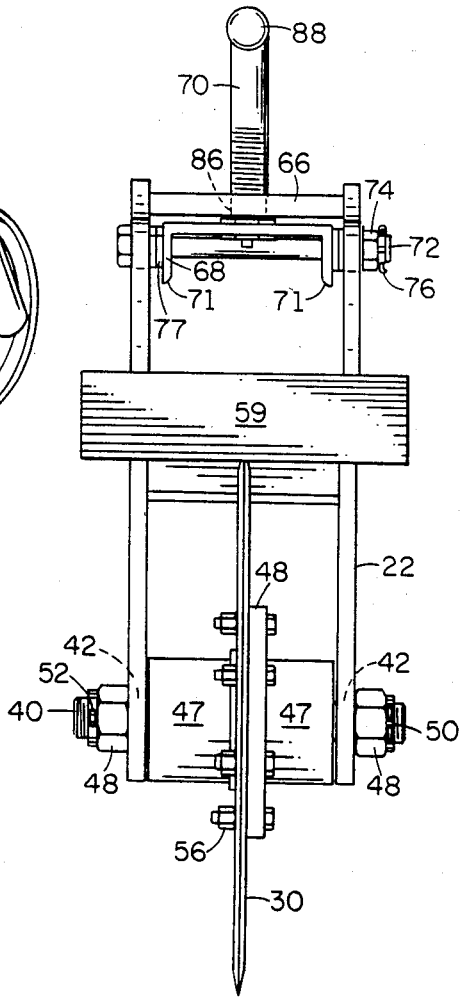
FIG. 2 is a rear elevational view of the invention with the clamping mechanism open.
Figure 2A:
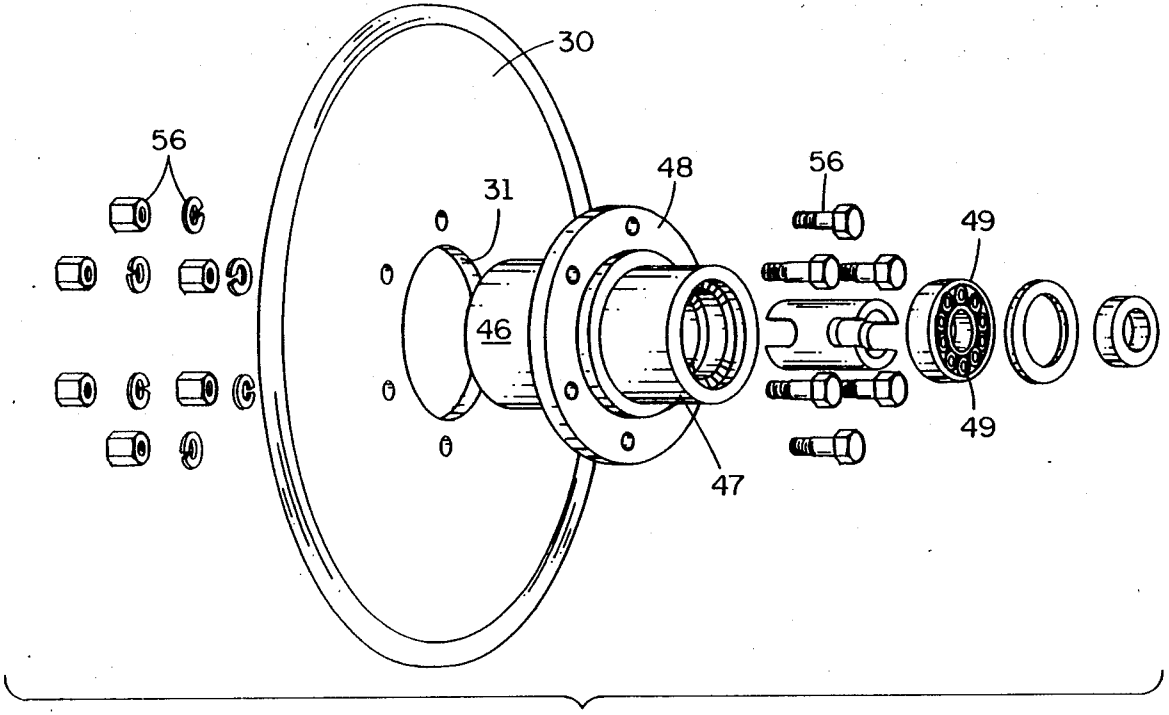
FIG. 2A is an exploded view of the attachment means used to attach a cutting wheel to the invention.

FIG. 2 and FIG. 2A show wheel 30 in further detail. Opposing apertures 42 are drilled into each lower panel 22. Axle 40 passes through these apertures 42. Axle 40 also passes through hub 46, which consists of a collar 47, a flange portion 48, and bearing assembly 49. Hub 46 fits into an aperture 31 in wheel 30, the aperture 31 having a circumference slightly larger than the outer diameter of hub 46. Hub 46 is affixed to wheel 30 by means of bolt, nut, and washer assemblies 56. Alternatively, hub 46 can be attached by other means, such as welding or lock pins. Collar 47 provides spacing between wheel 30 and each lower panel 22, and houses bearing assembly 49 or bushings (not shown). Flange portion 48 provides strength to wheel 30, preventing bending of wheel 30 during use.

Axle 40 is held in place by means of a threaded nut 48. At each end of axle 40, a cotter pin 50 passes through an aperture 52. Removal of a cotter pin 50 and nut 48 permits axle 40 to be slid out of position. Removal of bolts 56 permits wheel 30 to be slid away from hub 46, thereby permitting wheel 30 to be sharpened or replaced without disturbing bearing assembly 49. Wheel 30 is sized and spaced between plates 21 in a manner that permits wheel 30 to rotate under the notch in frame 20 when attached to an excavator bucket.

Figure 1A:
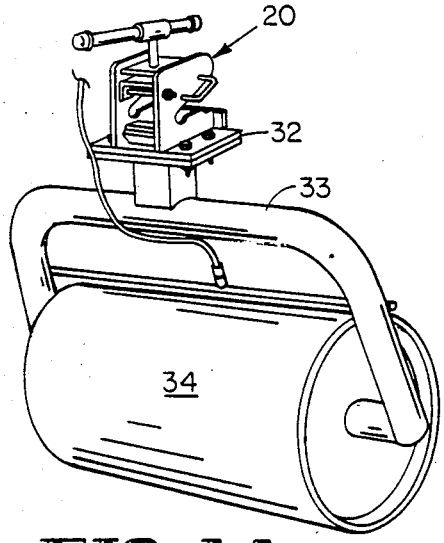
FIG. 1A is a front perspective view of the invention as used to attach a rolling tool.

FIG. 1A shows a second embodiment of the invention. As shown in FIG. 1A, frame 20 is easily adapted for use with other tools, here a rolling tool. For attachment of a roller, a base plate 32 connects to the bottom of frame 20. Base plate 32 serves as a mounting surface for roller support 33 and roller 34. Except for this adaptation of frame 20 to accommodate a roller rather than a cutter wheel, the invention is the same.

Referring again to FIG. 1, stabilizing bar 59 is affixed at the rear of frame 20. Stabilizing bar 59 is adjacent to the open end of the notch in frame 20, and connects plates 21. The top edge 60 of stabilizing bar 59 is in contact with the underside surface of the bucket when the invention is in use, preventing the tool from shifting from side to side. Stabilizing bar 59 is wider than frame 20, and extends equally from opposite sides of plates 21 to provide additional stability. In the preferred embodiment, stabilizing bar 59 is permanently affixed to frame 20 by means of welding.

Figure 3:
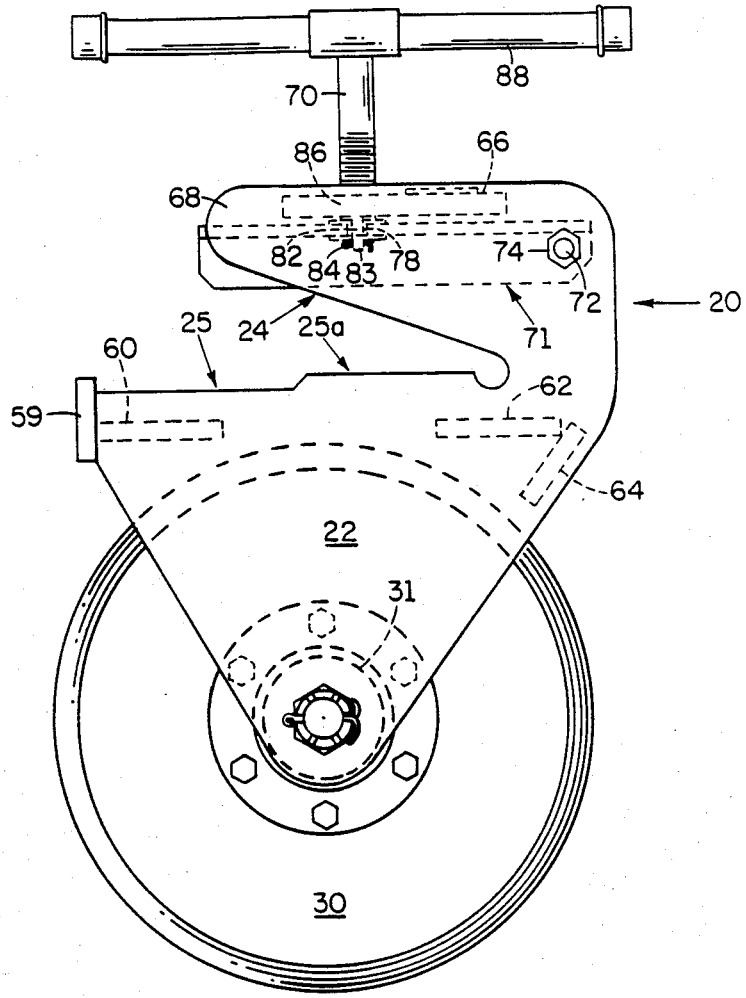
FIG. 3 is a side elevational view of the invention with the clamping mechanism open.

FIG. 3 shows how frame 20 may be shaped so that the ability of the invention to accommodate and securely hold various sizes of buckets may be maximized. The configuration of a typical bucket is significant to the design of the invention. A typical bucket has a cutting edge permanently attached along the outer lip of the bucket. Typically, the cutting edge is a piece of steel approximately 6 inches wide and 1 inch thick. To accommodate the cutting edge, or lip, the angle of the notch in frame 20 is approximately 30 degrees plus or minus 10 degrees, modified as required to suit various bucket sizes and lip constructions. This angle is selected to securely restrain the forward portion of the bucket against edge 24, and disperse contact between the invention and the bucket when engaged together. Specifically, this angle is slightly smaller than the angle of the cutting edge, or lip, of a typical bucket. Edge 24 is shorter than edge 25 so that the top of the notch in frame 20 is slightly receded from the bottom of the notch.

Both bearing edges 25 of frame 20 have a raised plateau 25*a*. The top surface of stabilizing bar 59 is approximately the same height as the raised plateau 25*a*. This ensures that there will be contact along the edge of the stabilizing bar 59, thereby providing as long a moment arm as possible to transmit operational forces to the bucket, thereby enhancing fore and aft stability when the tool is in use.

The distance along bearing edge 25, including its raised portion 25*a*, is at least 6 inches, which exceeds the width of a typical cutting edge. This distance is also greater than the typical length of any cutting teeth that may be affixed to the bucket, thereby ensuring that stabilizing bar 59 rests on the bucket behind the back edge of the teeth.

As shown in FIG. 3, braces 60, 62, and 64 are affixed between plates 21. They are located sufficiently near bearing edge 25, so that there is no interference with whatever tool is attached. Braces 60, 62, and 64 provide spacing between, and strength to, frame 20, and are permanently welded in place.

Screw plate 66 is affixed between plates 21 near the top of frame 20. Screw plate 66 works in conjunction with bearing arm 68 and clamp screw 70 to provide a means for clamping the invention to a bucket. Bearing arm 68 is pivotally attached to the front of frame 20 between plates 21 by means of pivot pin 72 inserted through opposing apertures 74 in bearing arm 68 and in plates 21. Pivot pin 72 is secured in place by means of nuts 74 and a locking cotter pin 76, which permits bearing arm 68 to be removed if desired. Washers 77 between each outer side of bearing arm 68 and inner surface of plates 21 permit bearing arm 68 to rotate around pivot pin 72.

Bearing arm 68 is generally shaped to provide a spaced pair of bearing surfaces to contact the bucket and maximize lateral stability. Its shape also facilitates sliding the unit over a tooth of a bucket with teeth. Accordingly, bearing arm 68 has two lower edges 71, and in the preferred embodiment has the shape of a channel bar with two parallel lower edges 71. The width of bearing arm 68 is slightly smaller than the inner width of frame 20. The length of bearing arm 68 and its pivot location at pivot pin 72 are predetermined so that there will be maximum contact along the lower edges 71 of bearing arm 68 and the bucket during use, thereby minimizing deformation of the bucket under the high clamping forces applied. In the preferred embodiment, bearing arm 68 extends only slightly beyond the top of the notch in frame 20 which, as explained above, is receded from the bottom of the notch.

Aperture 78 through the top of bearing arm 68 provides a point at which force is applied to baring arm 68 by clamp screw 70 during attachment of the invention to a bucket. Clamp screw 70 has a narrowed tip 82, which is inserted through aperture 78. A bore 83 through the bottom of tip 82 and a cotter pin 84 provide a means for fastening clamp screw 70 to bearing arm 68. Because tip 82 is secured only by cotter pin 84, it is rotatable within aperture 78. The size of aperture 78 is sufficient to permit such movement, or play, of tip 82 within aperture 78. This permits bearing arm 68 to be pivoted without breaking tip 82.

Above tip 82, clamp screw 70 passes through a threaded aperture 86 in screw plate 66. Clamp screw 70 is also threaded so that it may be threaded up and down through screw plate 66. A handle 88, affixed to the top of clamp screw 70, permits the operator of the invention to easily turn clamp screw 70. If desired, handle 88 may slide within a collar 89, which permits the invention to be attached at one end of a bucket without interference by handle 88. The ability to slide handle 88 within collar 89 also enables the operator to obtain additional leverage, if necessary, during attachment or removal of the invention.

The point of attachment of clamp screw 70 to bearing arm 68 at tip 82 is predetermined to enable the operator to tighten clamp screw 70 without creating undue leverage on bearing arm 68. In the preferred embodiment, this point of attachment is selected so that the distance between tip 82 and pivot pin 72 is approximately twice the distance between tip 82 and the front of bearing arm 68.

As shown in FIG. 1, an additional feature of the invention is a handle 90 on each side of frame 20. Handle 90 facilitates positioning of the invention on the lip of the bucket. The size of handle 90 is selected so that it helps to support the invention when it is unattached and laid in a horizontal position. Accordingly, handle 90 extends from the side of the invention approximately the same distance as stabilizing bar 59 or axle 40. This facilitates transportation and packaging of the invention.

Figure 4A:
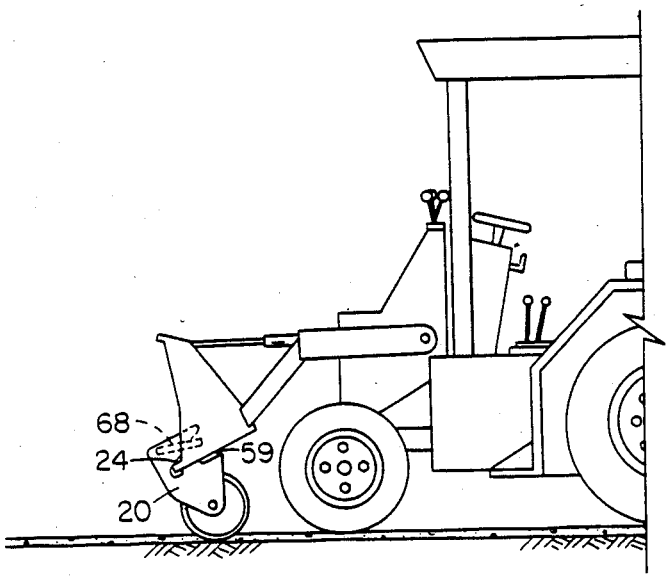
FIG. 4A is a perspective view of the invention in use with an asphalt cutting tool, clamped to the bucket of a front end loader.
Figure 4B:
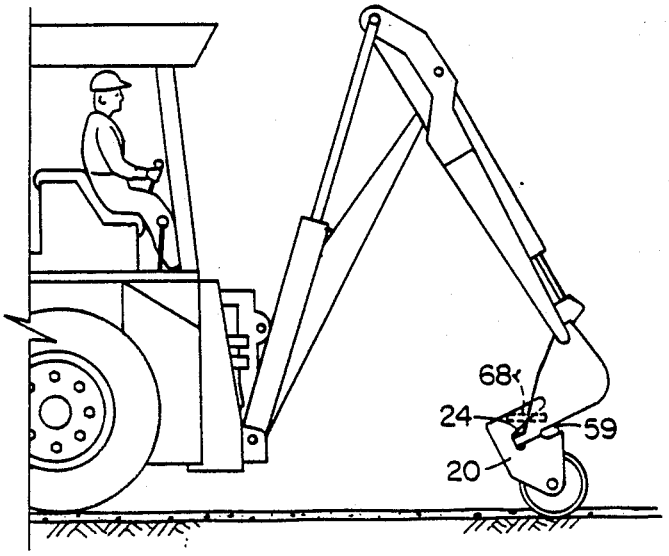
FIG. 4B is a perspective view of the invention in use with an asphalt cutting tool, clamped to the bucket of a backhoe.

FIG. 4A shows the invention mounted on the bucket 10 of a front-end loader. The invention may be similarly mounted on the bucket of a backhoe as shown in FIG. 4B. As shown in FIGS. 4A and 4B, while being used to cut a surface such as asphalt, the invention is typically about 30 degrees forward of perpendicular to the ground. This angle creates a particular relationship between the forces applied to the tool and the invention and the position of the contact points on the invention. This relation causes the bucket to become even more tightly wedged into the notch in frame 20, and minimizes the load on the clamping mechanism. The bucket position stays the same regardless of the direction of travel. The ability to so position the bucket provides the best overall visibility of the tool during use.

To attach the device to a bucket, the bucket is moved to place the floor of the bucket at an elevation appropriate to the height of the tool to be attached. The bucket is positioned so that its floor is substantially horizontal to the ground. With the bucket in this position, while bearing arm 68 is in the open position shown in FIG. 3, the bucket is moved into the notch in frame 20. The bucket is pushed into the notch until its lip contacts bearing edges 24 and 25. When the bucket is in the desired position, clamp screw 70 is screwed down through aperture 86 causing the bottom of screw 80 to press against the top of bearing arm 68. This causes the lower edges 71 of bearing arm 68 to press against the inside wall of the bucket. Screw 80 is tightened until stabilizing bar 59 is pressed flush against the underside of the bucket wall. In the clamped position, the bucket is firmly held between stabilizing bar 59 and edge **25*a* which press against the bucket's underside, and bearing arm 68 and edge 24**, which press against the bucket's inner wall.

After the bucket has been clamped to the invention in this manner, and while the invention is in use, there are a number of zones of contact at which pressure bears on the bucket. The zones of contact vary according to the shape of the bucket, but as explained above, the angle of the notch in frame 20 is selected to be slightly smaller than the angle of a typical cutting edge of a bucket so that contact will be dispersed along these edges 24 and 25. Thus, stabilizing bar 59 provides contact along the underside of the bucket. The raised portion **25*a* of bearing edges 25 provide another two contact areas. Bearing arm 68 provides two additional contact areas along its bottom edges 71. Depending on the shape of the cutting edge of the bucket, these contact areas will vary in length; they may be as short as a point at the forwardmost edge of pivot arm 68, or as long as the entire distance of its bottom edge 71. Typically, they will be a length approximately midway between these two extremes. Bearing edge 24 provides two more contact areas. The gap formed along edge 25 between stabilizing bar 59 and its raised plateau 25*a* accommodates for local distortion or curvature of the bucket and encourages contacts to be spaced and shared by stabilizing bar 59 and raised edge 25*a***. There is minimal or no contact at the leading edge of the bucket lip.

During operation of the invention, the excavating equipment drives the invention to the left as shown in FIG. 4A and FIG. 4B. The pressure of the cutter as it moves and cuts through the surface is directed against the stabilizing bar 59. This force tends to rotate the frame in a counterclockwise direction, but is counteracted by bearing edge 24. The result is that forces on bearing arm 68 are lessened.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. It is therefore contemplated that the appended claims will cover such modifications that fall within the true scope of the invention.

What is claimed is:

1. An apparatus for selectively attaching one of a plurality of earth-working tools to excavating equipment having a bucket mounted thereon, said bucket having a lip comprising:

a frame, said frame having a wedge-shaped notch for receiving the lip of said bucket, said notch having an open end and an apex and an upper surface and a lower surface, said lower surface comprising a generally flat surface and a raised plateau relative said generally flat surface, said upper surface providing a first contact against said bucket, on the inside surface of said bucket, and said lower surface raised plateau providing a second contact against said bucket, on the outside surface of said bucket, said contacts being spaced from the apex of said notch, said apex lying below said raised plateau of said lower surface;

means for clamping said frame to said bucket, said clamping means being attached to said frame above said notch, said clamping means including a pivoting bearing arm, said bearing arm provides a third contact against said bucket on the inside surface of said bucket;

a stabilizing bar attached to said frame at the open end of said notch, said stabilizing bar providing a fourth contact against said bucket, on the outside surface of said bucket;

means for supporting said tool, said tool supporting means being affixed to said frame beneath said notch.

2. The apparatus of claim 1, wherein said frame is comprised of two spaced parallel plates, which are generally triangular in shape.

3. The apparatus of claim 2, wherein said clamping means comprises a screw contacting the top of said bearing arm.

4. The apparatus of claim 3 wherein said bearing arm is pivoted by means said screw.

5. The apparatus claimed of claim 4 wherein said screw has a handle at its top end.

6. The apparatus of claim 1 wherein said bearing arm comprises a channel shaped bar, such that contact is provided against said bucket by two parallel edges of said channel shaped bar.

7. The apparatus of claim 1, wherein said raised plateau provides a gap between the contact provided by said stabilizing bar and the contact provided by said lower surface.

8. The apparatus of claim 1, wherein said frame has a handle on at least one side.

9. The apparatus of claim 1, wherein said means for attaching said tool comprises an axle to which a wheel may be rotatally attached.

10. The apparatus of claim 9, wherein said means for attaching said tool further comprises bearings for facilitating rotation of said wheel, and a hub removably attached to said wheel such that said wheel may be removed without displacing said bearings.

11. The apparatus of claim 1, wherein said means for attaching said tool comprises a mounting plate attached to the bottom of said frame, said mounting plate being suitable for attaching a roller.

12. An apparatus for selectively attaching one of a plurality of earth working tools to excavating equipment having a standard size bucket mounted thereon said bucket having a leading edge, comprising:

a frame having a wedge-shaped notch having an open end for receiving the leading edge of said bucket, said notch having an apex whose angle is shaped so that when the leading edge of said bucket is inserted into said notch, said leading edge will not be in contact with said notch at said apex, said notch having an upper surface and a lower surface, said lower surface comprising a generally flat surface and a raised plateau relative said generally flat surface, said upper surface providing a first contact against said bucket, on the inside surface of said bucket, and said lower surface raised plateau providing a second contact against said bucket, on the outside surface of said bucket said apex lying below said raised plateau of said lower surface;

means for clamping said frame to said bucket, said clamping means being attached to said frame above said notch, said clamping means including a pivoting bearing arm, said bearing arm providing a third contact against said bucket on the inside surface of said bucket;

a stabilizing bar attached to said frame at the open end of said notch, said stabilizing bar providing a fourth contact against said bucket, on the outside surface of said bucket;

means for supporting said tool, said tool supporting means being affixed to said frame beneath said notch.

13. The apparatus of claim 12, wherein said frame is comprised of two spaced parallel plates, which are generally triangular in shape.

14. The apparatus of claim 12, wherein said clamping means comprises a screw contacting the top of said bearing arm.

15. The apparatus of claim 14, wherein said bearing arm is pivoted by means of said screw.

16. The apparatus of claim 12, wherein said bearing arm comprises a channel shaped bar, such that contact is provided against said bucket by two parallel edges of said channel shaped bar.

17. The apparatus of claim 12, wherein said raised plateau, provides a gap between the contact provided by said stabilizing bar and the contact provided by said lower surface.

18. An apparatus for selectively attaching one of a plurality of earth working tools to excavating equipment having a bucket mounted thereon, said bucket having a leading edge, comprising:

a frame having a wedge-shaped notch, for receiving the leading edge of said bucket, said notch having an apex and having an upper surface and a lower surface, said lower surface comprising a generally flat surface and a raised plateau relative said generally flat surface, said upper surface providing a first contact against said bucket, on the inside surface of said bucket, and said lower surface raised plateau providing a second contact against said bucket, on the outside surface of said bucket said leading edge being spaced from said apex;

means for clamping said frame to said bucket, said clamping means being attached to said frame above said notch, said clamping means including a pivoting member, wherein said pivoting member provides a third contact against said bucket on the inside surface of said bucket;

a stabilizing bar attached to said frame at the base of said notch, said stabilizing bar providing a fourth contact against said bucket, on the outside surface of said bucket; said fourth contact being offset from said third contact;

means for supporting said tool, said tool supporting means being affixed to said frame beneath said notch.

19. The apparatus of claim 18, wherein said frame is comprised of two spaced parallel plates, which are generally triangular in shape.

20. The apparatus of claim 18, wherein said clamping means comprises a screw contacting the top of said bearing arm.

21. The apparatus of claim 20, wherein said bearing arm is pivoted by means of said screw.

22. The apparatus of claim 18, wherein said bearing arm comprises a channel shaped bar, such that contact is provided against said bucket by two parallel edges of said channel shaped bar.

23. The apparatus of claim 18, wherein said raised plateau, provides a gap between the contact provided by said stabilizing bar and the contact provided by said lower surface.

* * * * *